US005137468A

United States Patent [19]

Murakami

[11] Patent Number: 5,137,468

[45] Date of Patent: Aug. 11, 1992

[54] ELECTRICAL CONNECTOR FOR FLEXIBLE PLANE-TYPE CONDUCTOR CABLE

[75] Inventor: Koji Murakami, Mie, Japan

[73] Assignee: Sumitomo Wiring Systems, Ltd., Mie, Japan

[21] Appl. No.: 693,199

[22] Filed: Apr. 30, 1991

[30] Foreign Application Priority Data

May 9, 1990 [JP] Japan ..... 2-48447[U]

[51] Int. Cl.[5] ..... H01R 4/24

[52] U.S. Cl. ..... 439/422; 439/424

[58] Field of Search ..... 439/421, 422, 877-879, 439/391, 492, 424

[56] References Cited

U.S. PATENT DOCUMENTS

| | | | |
|---|---|---|---|
| 3,881,796 | 5/1975 | Saunders | 439/422 |
| 4,012,101 | 3/1977 | Damoisiaux et al. | 439/422 |
| 4,082,402 | 4/1978 | Kinkaid et al. . | |
| 4,124,266 | 11/1978 | Wagstaff | 439/422 |
| 4,560,225 | 12/1985 | Margaroli et al. | 439/422 |

FOREIGN PATENT DOCUMENTS 1466086 12/1973 United Kingdom .

*Primary Examiner*—David L. Pirlot

*Attorney, Agent, or Firm*—Sughrue, Mion, Zinn, Macpeak & Seas

[57] ABSTRACT

An electrical connector comprises crimping pieces of tongue-like sheet integrally provided on the side edges of a web in such a manner as to erect therefrom and arc contact portions each comprising an arc substantially normal to the sheet body of the crimping piece, and the crimping piece is formed as a curled portion so as to be superimposed over the contact portion, whereby a flexible plane-type conductor cable is securely held between the superimposed portions for establishing electrical connection therebetween. The arc contact portion is formed as a recessed arc contact portion, and the external arc of the curled portion and this recessed arc are brought into concentric arc relationship.

5 Claims, 3 Drawing Sheets

ELECTRICAL CONNECTOR FOR FLEXIBLE PLANE-TYPE CONDUCTOR CABLE

BACKGROUND OF THE INVENTION

1. Field of the Invention

The present invention relates to an electrical connector connected to a flexible plane-type conductor cable formed as a flexible thin sheet body which comprises belt-like conductor portions arranged in parallel to each other and a film-like insulation sheath applied thereover. This flexible plane-type conductor cable is hereinafter referred to as an "FPC".

2. Statement of the Prior Art

A conventional electrical connector for an FPC is known in the official gazette of Japanese Patent Publication No. 48833/1982 (examined) or the like. The construction and problems of this known electrical connector will be described with reference to FIGS. 5 to 7 for convenience. FIG. 5 is a perspective view of the known electrical connector, FIG. 6 a cross-sectional view taken along the line VI—VI of FIG. 5, and FIG. 7 a partially enlarged cross sectional view showing a state in which the electrical connector shown in FIG. 5 is in use.

As shown in FIG. 5, the known electrical connector 1 is basically constructed such that crimping pieces 3 of tongue-like sheet are provided on the side edges of a web 2 in such a manner as to erect therefrom and that an arc contact portion 5 comprising an expanded arc 4 substantially normal to the sheet body of the crimping piece 3 is provided on the web 4 at a position adjacent to the joint between the crimping piece 3 and the web 2 in a raised fashion for each crimping piece 3.

As shown in FIGS. 6 and 7, an FPC 6 to which this electrical connector 1 is attached is formed into a flexible sheet body comprising belt-like conductor portions 7 arranged in parallel to each other and securely sealed with a film-like insulation sheath 8. The crimping pieces 3 are caused to penetrate through this FPC 6 at predetermined positions, and the upper half portion of each crimping piece 3 that has penetrated through the FPC 6 is then crimped in a direction indicated by an arrow 31 in FIG. 6, i.e. toward over the arc contact portion 5 so as to form a curled portion 10, which is then brought into press contact with the arc contact portion 5 to thereby securely hold the FPC 6 therebetween. When securely held by means of the curled portion, the insulation sheath 8 of the FPC 6 is partially stripped off by means of the leading-end edge of the crimping piece 3, which allows to the conductor portion 7 and the curled portion 10 of the crimping piece 3 to electrically contact each other. Thus, the electrical connector 1 is securely attached to the FPC 6 for electrical connection.

In the conventional electrical connector 1 constructed as described above, since the arc contact poerion 5 that is laid over the curled portion 10 comprises the expanded arc 4, the external arc 11 of the curled portion 10 and the expanded arc 4 are brought into circumscribed arc relationship via the FPC 6 from a geometrical point of view.

As a result of this, since a dot contact or an approximate dot contact is established between the conductor portion 7 and the circumscribed arcs 4 and 11, it is not possible to have a contact allowing good electricity conducting therebetween at all times. Moreover, if there is even a slight error in the accuracy with which the crimping piece 3 is curl processed, the dot contact between the leading-end edge of the crimping piece 3 which is on the moving side and the FPC 6 which is on the fixed side becomes too much or too little, causing a case in which the FPC 6 is damaged or the insulation sheath 8 is not sufficiently stripped off. However, the control of accuracy with which curl processing is carried out is extremely difficult from a mass-production technology point of view, and there is a drawback that articles having unstable electrical connection with the FPC 6 are produced.

SUMMARY OF THE INVENTION

An object of the present invention is to obtain an electrical connector having a stable electricity conducting performance.

Another object of the present invention is to obtain an electrical connector which is easily processed for electrical connection with an FPC.

In order to accomplish the above objects, the present invention provides an electrical connector for an FPC comprising crimping pieces of tongue-like sheet integrally provided on the side edges of a web in such a manner as to erect therefrom and arc contact portions each comprising an arc substantially normal to the sheet body of the crimping piece, wherein the crimping piece is formed as a curled portion so as to be superimposed over the contact portion, the conductor portion of the FPC being thereby securely held between the superimposed portions for establishing electrical connection therebetween, the electrical connector being characterized in that the contact portions are each formed as a recessed arc, and that external arcs of the curled portions and the recessed arcs are brought into concentric arc relationship, respectively.

The electrical connector of the present invention has on the web an arc contact portion comprising a recessed arc. When the crimping piece is bent so as to form a curled portion, which is then superimposed on the arc contact portion, the external edge of the curled portion and the recessed arc are brought into concentric circle relationship, and the leading-end edge of the crimping piece is guided along the recessed arc on the fixed side when it is moved to be curled, and is smoothly superimposed thereover, and this serves to reduce as low as possible a risk of the FPC securely held between the recessed arc and the crimping piece being damaged or of the insulation sheath applied on the FPC being insufficiently stripped off, whereby a surface contact is established between the conductor portion of the FPC and the crimping piece of the electrical connector, stable electricity conduction being thereby accomplished.

DETAILED DESCRIPTION OF THE PREFERRED EMBODIMENTS

Referring to FIGS. 1 to 4, an embodiment of an electrical connector according to the present invention will be described.

Figure 1:
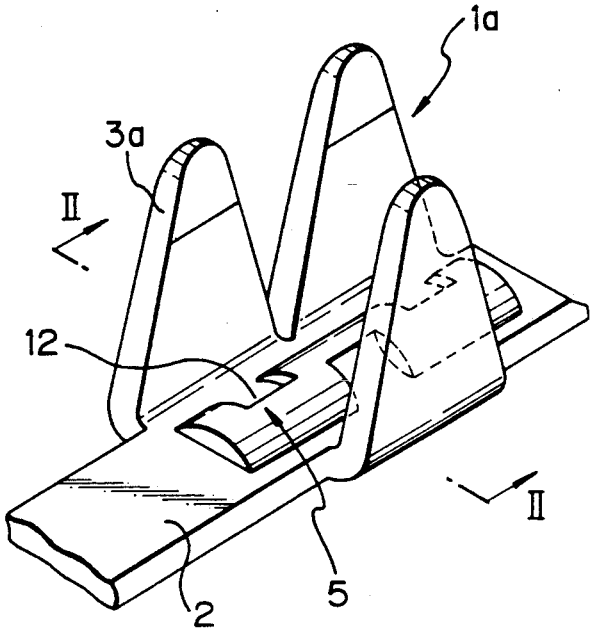
FIG. 1 is a perspective view of one of the embodiment of an electrical connector according to the present invention.
Figure 2:
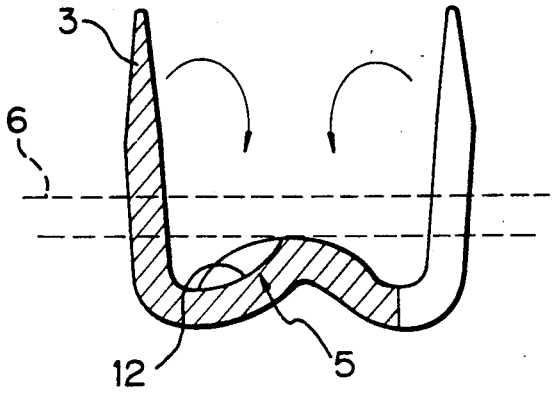
FIG. 2 is a cross-sectional view taken along the line II—II of FIG. 1.
Figure 3:
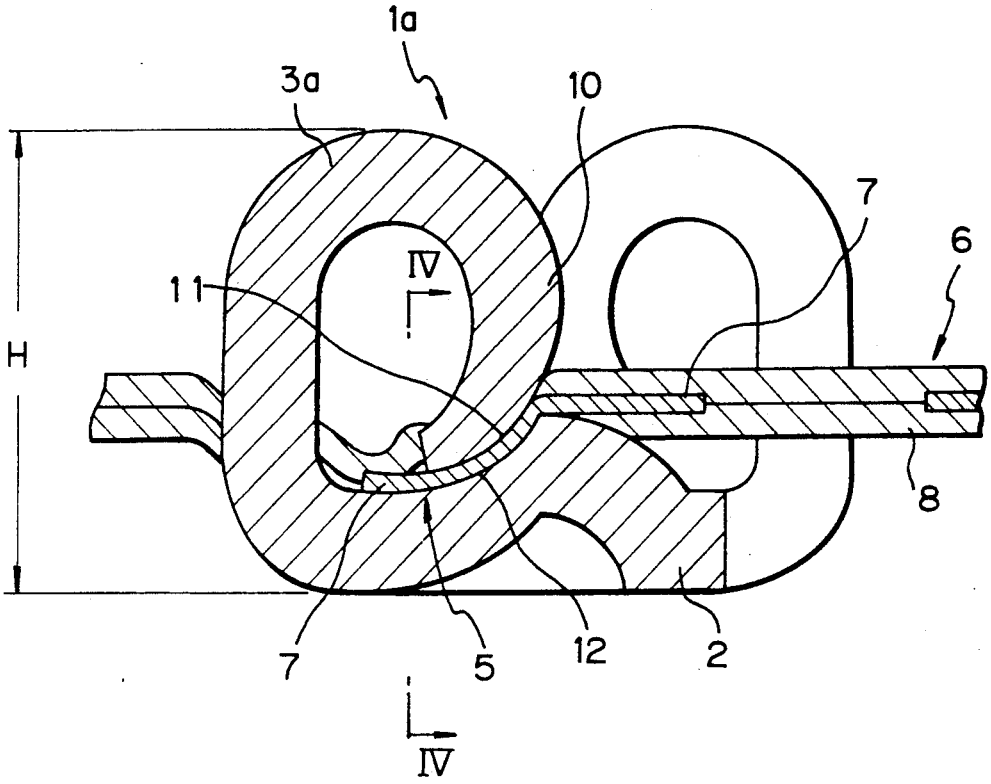
FIG. 3 is a partially enlarged cross-sectional view showing a state in which the electrical connector of FIG. 1 is in use.
Figure 4:
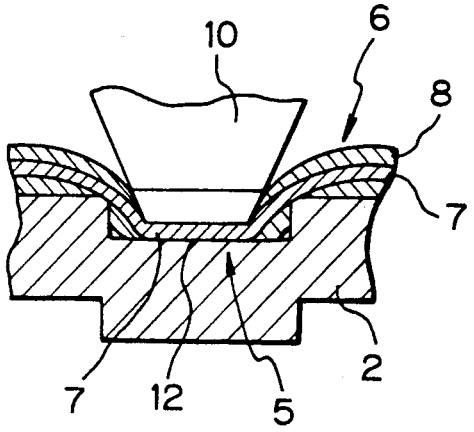
FIG. 4 is a cross-sectional view taken along the line IV—IV of FIG. 3.
Figure 5:
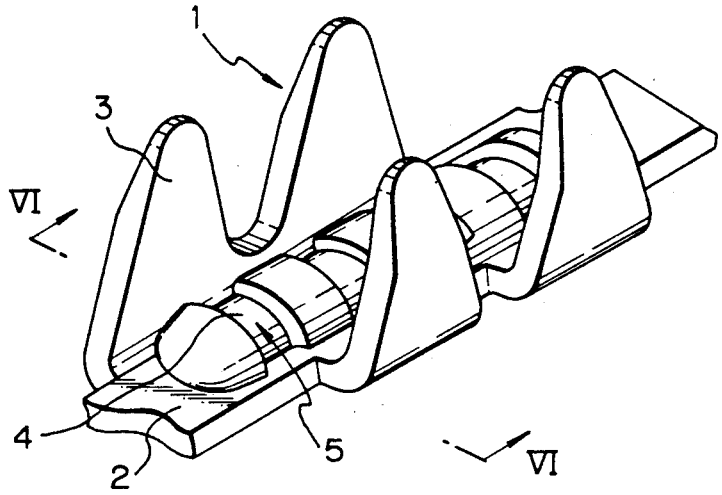
Fig. 5 PRIOR ART
FIG. 5 is a perspective view of a known electrical connector.

Referring first to FIG. 1 showing one embodiment of an electrical connector 1*a* for an FPC according to the present invention, crimping pieces 3*a* of tongue-like sheet are provided on the side edges of a web 2 in such a manner as to erect therefrom. Arc contact portions 5 are provided on the upper side of the web 2 in such a manner as to become substantially normal to the crimping pieces 3*a*, respectively. The electrical connector is attached to the FPC 6 by causing the upper half portions of the crimping pieces 3*a* to penetrate through the FPC 6 at predetermined positions, and the crimping pieces 3*a* so penetrating the FPC 6 are then inwardly bent so as to form a curled portion 10. This curled portion 10 is then superimposed over each arc contact portion 5 to securely hold the FPC 6 therebetween. Thus, the crimping pieces 3*a* are electrically attached to the conductor portion 7 of the FPC 6, and an electrical connection is established therebetween.

In the electrical connector 1*a* for an FPC, the arc contact portion 5 comprises a recessed arc 12, and this recessed arc 12 and an external arc 11 of the curled portion 10 that is superimposed over the recessed arc 12 are brought into concentric arc relationship and constitute a recessed arc contact portion.

When deciding on the configuration of the recessed arc 12, the configuration of the curled portion 10 formed by the crimping piece 3*a* is taken into consideration in advance and is formed such that when the curled portion 10 formed by bending the crimping piece 3*a* is superimposed over the recessed arc 12, the external arc 11 of the curled portion 10 and the recessed arc 12 are brought into concentric arc relationship.

Figure 6:
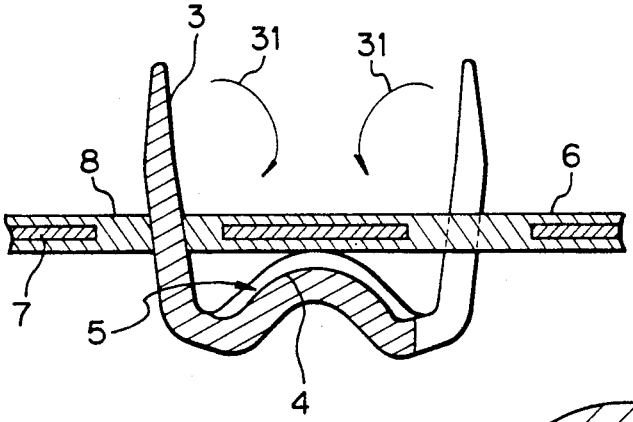
Fig. 6 PRIOR ART
FIG. 6 is a cross-sectional view taken along the line VI—VI of FIG. 5.
Figure 7:
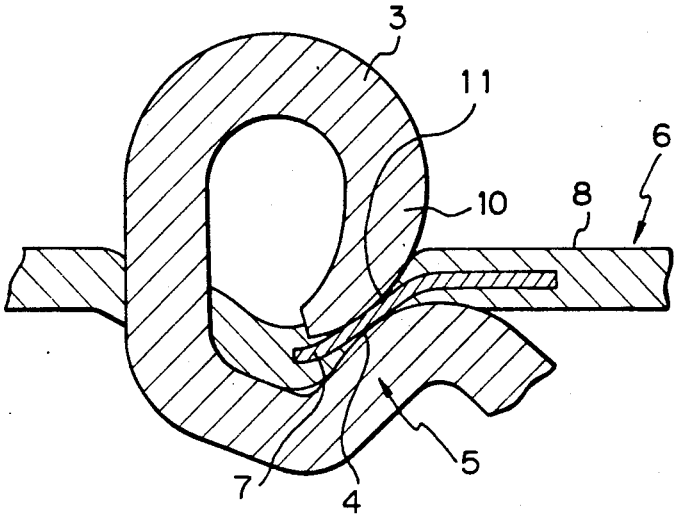
Fig. 7 PRIOR ART
FIG. 7 is a partially enlarged cross-sectional view showing a state in which the electrical connector shown in FIG. 5 is in use.

The electrical connector 1*a* so constructed is, as in the case of the conventional counterparts shown in FIGS. 6 and 7, attached to the FPC at the predetermined positions thereof by causing the crimping pieces 3*a* to penetrate through the FPC. Afterwards, the upper half portions of the crimping pieces 3*a* are formed as the curled portion 10 using a crimping tool (not shown) and are then pressed downwardly, during which the moving lower end edge of the curled portion 10 strips off the part of the insulation sheath 8 of the FPC 6 securely held between the recessed arc 12 and the curled portion 10, and the exposed conductor portion 7 and the curled portion 10 are brought into press contact with each other for electrical connection.

In the electrical connector according to the above embodiment functioning as described above, it is possible to establish stable electricity conduction via surface contact. Furthermore, since it is possible to control the degree of contact between the curled portion 10 and the arc contact portion 5 using, for instance, the crimp height as an alternative characteristic, the control during the production processes can easily be achieved, a risk of FPC damage or electricity conduction failure caused by excessive or insufficient contact being thereby reduced as low as possible.

Furthermore, the radius of the recessed arc 12 of the present invention is not limited to a single radius, but a composite arc comprising a series of arcs having different radii may be used, and the recessed arc 12 and the external arc 11 of the curled portion 10 may not necessarily be brought into geometrically concentric arc relationship, but may be brought into any approximate/similar concentric arc relationship.

As is described above, the electrical connector of the present invention has the following advantages: since it provides surface electrical contact between the conductor portion of the FPC and itself, the electricity conducting performance can be improved; processing for electrical connection with the FPC can smoothly be carried out to thereby prevent the production of defective articles having electricity conduction failures; and the operational control of processing for electrical connection can easily be achieved.

What is claimed is:

1. An electrical connector for a flexible plane-type conductor cable including a belt-like conductor portion and an insulating portion surrounding said conductor portion, comprising:

a longitudinally extending web;

a plurality of crimping pieces integrally provided on opposite sides of said web and protruding outwardly therefrom;

a plurality of arc contact portions recessed in said web and respectively disposed adjacent said crimping pieces, said contact portions being at least partially defined by a top longitudinally extending edge and a pair of side edges, wherein said conductor cable is secured to said connector by curling each of said crimping pieces such that a curled portion thereof is superimposed over each of said contact portions in a concentric arc relationship with said cable disposed therebetween, and wherein when each of said crimping pieces are curled, said top edge portion of each of said arc contact portions partially strips said insulating portion so that said conductor portion directly contacts each of said arc contact portions.

2. The connector of claim 1 wherein said crimping pieces and said arc contact portions provided on one side of said web are alternatingly disposed with respect to the crimping pieces and arc contact portions provided on the other side of said web such that said crimping pieces do not oppose one another.

3. The connector of claim 1 wherein each of said side edges mechanically retain said conductor portion between each of said curled portions of said crimping pieces and each of said arc contact portions.

4. The connector of claim 1, wherein said top edge is provided at the uppermost portion of said arc contact portions to thereby maximize the area of said contact portions.

5. An electrical connector as set forth in claim 1, wherein said recessed arc is a composite arc comprising a series of arcs having different radii.

* * * * *